US009497808B2

(12) United States Patent
Murata et al.

(10) Patent No.: US 9,497,808 B2
(45) Date of Patent: Nov. 15, 2016

(54) LED DRIVE CIRCUIT AND LED ILLUMINATION APPARATUS

(75) Inventors: Takeshi Murata, Osaka (JP); Atsushi Kanamori, Osaka (JP); Hirohisa Warita, Osaka (JP); Hideo Matsuda, Osaka (JP); Takayuki Shimizu, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 701 days.

(21) Appl. No.: 13/290,163

(22) Filed: Nov. 7, 2011

(65) Prior Publication Data

US 2012/0126708 A1 May 24, 2012

(30) Foreign Application Priority Data

Nov. 19, 2010 (JP) ..... 2010-258433

(51) Int. Cl.
*H05B 33/08* (2006.01)

(52) U.S. Cl.
CPC ..... *H05B 33/0815* (2013.01)

(58) Field of Classification Search
CPC ..... H05B 33/0815; H05B 33/0845; H05B 37/02; H05B 33/0809; H05B 33/0818; H05B 33/0848; H05B 33/0851; H05B 33/0863; H05B 33/0854; H05B 33/0824; H05B 33/0866; H05B 33/0842
USPC ..... 315/209 R, 224, 225, 227 R, 291, 307, 315/308, 302, 311
See application file for complete search history.

(56) References Cited

U.S. PATENT DOCUMENTS

| | | | | |
|---|---|---|---|---|
| 8,222,832 | B2 * | 7/2012 | Zheng et al. | 315/291 |
| 8,698,420 | B2 * | 4/2014 | Maruyama | H05B 33/0815 315/297 |
| 2006/0158130 | A1 | 7/2006 | Furukawa | |
| 2006/0208667 | A1 * | 9/2006 | Lys et al. | 315/298 |
| 2007/0182338 | A1 * | 8/2007 | Shteynberg et al. | 315/200 R |
| 2010/0225251 | A1 | 9/2010 | Maruyama | |
| 2011/0080112 | A1 * | 4/2011 | Shearer et al. | 315/291 |
| 2011/0109239 | A1 * | 5/2011 | Kojima | 315/250 |
| 2012/0104970 | A1 | 5/2012 | Okubo et al. | |

FOREIGN PATENT DOCUMENTS

| | | | |
|---|---|---|---|
| JP | 2006-179672 | A | 7/2006 |
| JP | 2006-319172 | A | 11/2006 |
| JP | 2008-235530 | A | 10/2008 |
| JP | 2009-158173 | A | 7/2009 |
| JP | 2010-212267 | A | 9/2010 |
| JP | 2011-23165 | A | 2/2011 |
| JP | 2012-109211 | A | 6/2012 |

* cited by examiner

*Primary Examiner* — Jimmy Vu
*Assistant Examiner* — Henry Luong
(74) *Attorney, Agent, or Firm* — Birch, Stewart, Kolasch & Birch, LLP

(57) ABSTRACT

An LED drive circuit that is connectable to a phase control type of light adjuster and receives a voltage based on an a.c. voltage to drive an LED load, the LED drive circuit has a structure which includes: an adjustment signal generation portion that generates an adjustment signal in accordance with a characteristic of a phase control type of light adjuster which is connected to the LED drive circuit; and an adjustment portion that receives the adjustment signal to adjust a characteristic for driving the LED load.

19 Claims, 20 Drawing Sheets

LED DRIVE CIRCUIT AND LED ILLUMINATION APPARATUS

This application is based on Japanese Patent Application No. 2010-258433 filed on Nov. 19, 2010, the contents of which are hereby incorporated by reference.

BACKGROUND OF THE INVENTION

1. Technical Field of the Invention

The present invention relates to: an LED (Light Emitting Diode) drive circuit that drives an LED; and an LED illumination apparatus that uses an LED as a light source.

2. Description of the Prior Art

An LED has features of a low electric-current consumption, a long life and the like and is spreading its application into not only a display apparatus but also an illumination apparatus and the like (e.g., see JP-A-2008-235530 and JP-A-2006-319172). Here, in an LED illumination apparatus, to obtain a desired illuminance, a plurality of LEDs are used in many cases.

A general illumination apparatus often uses a commercial 100 VAC power supply; and considering a case and the like where an LED illumination apparatus is used instead of the general illumination apparatus such as an incandescent lamp and the like, it is desirable that the LED illumination apparatus also is so structured as to use the commercial 100 VAC power supply like the general illumination apparatus.

Besides, in a case where light adjustment control is applied to an incandescent lamp, a phase control type of light adjuster (generally called incandescent lamp light controller) is used which is able to easily perform the light adjustment control by turning on a switching element (generally, a thyristor element or a TRIAC element) at a phase angle of an a.c. power supply voltage and by supplying electricity to the incandescent lamp by means of only one volume element.

Various techniques are necessary to connect the LED illumination apparatus to an existing phase control type of light adjuster; and a design value as one of the techniques significantly depends on the light adjuster that is used. However, there are many kinds of light adjusters, so that there are many cases where it is hard to imagine to what kind of light adjuster the LED illumination apparatus is connected in designing an LED drive circuit and an LED of the LED illumination apparatus. There is a case where even if erroneous operation does not occur and a light adjustment characteristic is appropriate in a light adjuster, erroneous operation such as a flicker and the like occurs and the light adjustment characteristic is improper in another light adjuster. Besides, there is a case where a design value is set to deal with various kinds of light adjusters, which however causes problems that the electric-current consumption of the LED increases and the efficiency deteriorates.

SUMMARY OF THE INVENTION

It is an object of the present invention to provide an LED drive circuit and an LED illumination apparatus that are able to appropriately drive an LED even in a case where they are connected to any phase control type of light adjuster.

To achieve the above object, an LED drive circuit according to the present invention is an LED drive circuit that is connectable to a phase control type of light adjuster, receives a voltage based on an a.c. voltage to drive an LED load and has a structure which includes:

an adjustment signal generation portion that generates an adjustment signal in accordance with a characteristic of a phase control type of light adjuster which is connected to the LED drive circuit; and an adjustment portion that receives the adjustment signal to adjust a characteristic for driving the LED load.

Besides, in the above structure, a structure may be employed in which the adjustment signal generation portion detects a characteristic of the connected phase control type of light adjuster and generates an adjustment signal in accordance with a detection result.

Besides, in the above structure, a structure may be employed in which the adjustment signal generation portion generates an adjustment signal in accordance with a switch changeover.

Besides, in any one of the above structures, a structure may be employed in which the adjustment signal generation portion generates an adjustment signal that has a voltage in accordance with an impedance at an off time of the phase control type of light adjuster.

Besides, in the present structure, a structure may be employed in which during a time the phase control type of light adjuster is in an off state, the adjustment portion subtracts an electric current from an electricity supply line, which supplies a driving electric current to the LED load, by an electric-current subtraction amount in accordance with the adjustment signal received from the adjustment signal generation portion.

Besides, in any one of the above structures, a structure may be employed in which the adjustment signal generation portion generates an adjustment signal in accordance with at least one of a maximum light amount time phase angle and a minimum light amount time phase angle of the phase control type of light adjuster.

Besides, in the present structure, a structure may be employed in which the adjustment portion adjusts a light adjustment characteristic in accordance with the adjustment signal received from the adjustment signal generation portion.

Besides, in any one of the above structures, a structure may be employed in which the adjustment signal generation portion generates an adjustment signal in accordance with at least one of an amplitude, a resonance frequency, a resonance pulse number at a portion where an electric current of an electric-current hold portion of the phase control type of light adjuster resonates.

Besides, in the present structure, a structure may be employed in which based on the adjustment signal received from the adjustment signal generation portion, the adjustment portion decides at least one of an electric-current subtraction amount and an electric-current subtraction time; and based on a decision result, subtracts an electric current from an electricity supply line for supplying a driving electric current to the LED load starting at timing the phase control type of light adjuster is turned on.

Besides, in any one the above structures, a structure may be employed in which the adjustment signal generation portion generates an adjustment signal that has a voltage in accordance with a hold electric current of an electric-current hold portion of the phase control type of light adjuster.

Besides, in the present structure, a structure may be employed in which based on the adjustment signal received from the adjustment signal generation portion, the adjustment portion decides an electric-current subtraction amount; and based on a decision result, subtracts an electric current from an electricity supply line for supplying a driving electric current to the LED load.

Besides, in the above structure, a structure may be employed which further includes a photodiode that receives light from the LED load; wherein based on an output from the photodiode, the adjustment signal generation portion generates the adjustment signal.

Besides, in the above structure, a structure may be employed in which the adjustment signal generation portion includes an external switch, changes and generates a combination of respective adjustment signals in accordance with a plurality of kinds of characteristics of the connected phase control type of light adjuster by operating the external switch.

Besides, an LED illumination apparatus according to the present invention includes the LED drive circuit having any one of the above structures; and an LED load connected to an output side of the LED drive circuit.

DESCRIPTION OF THE PREFERRED EMBODIMENTS

First Embodiment

Figure 1:
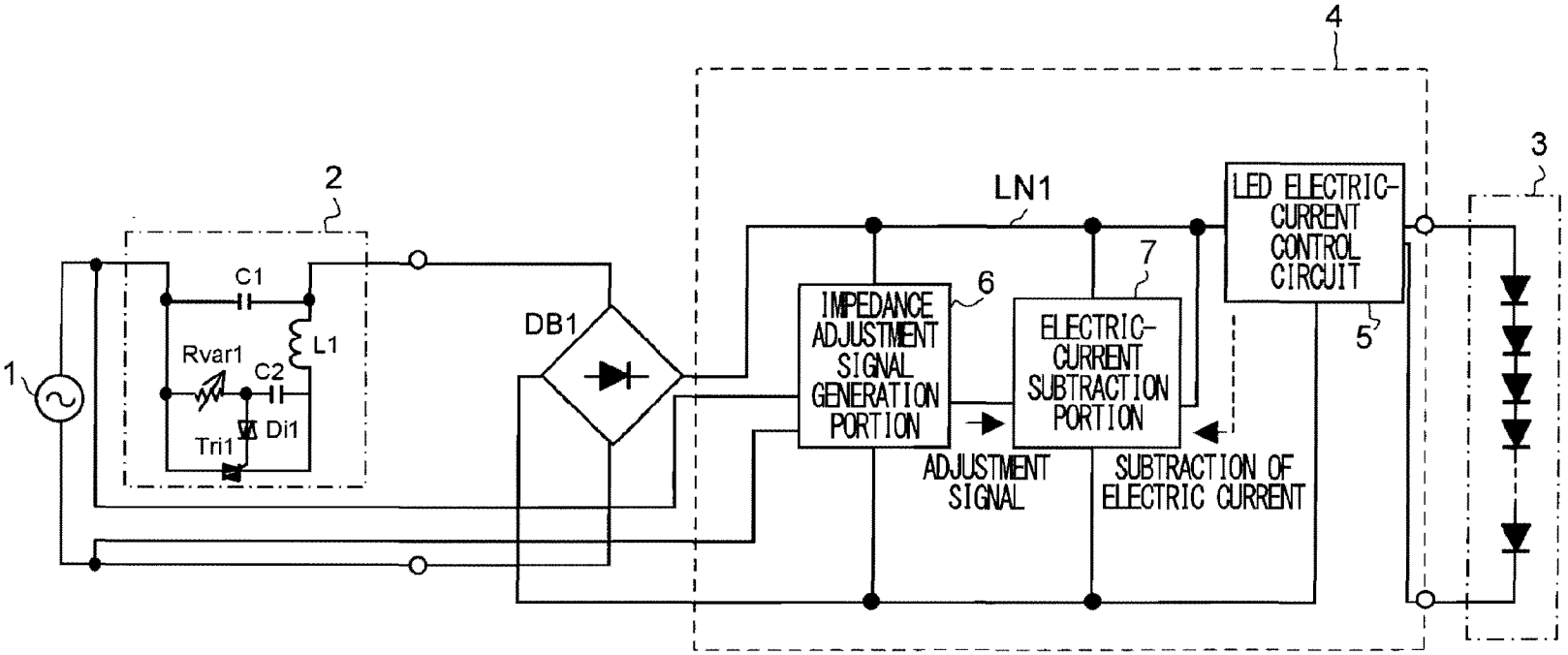
FIG. 1 is a view showing a structure of an LED illumination system according to a first embodiment of the present invention.

Hereinafter, embodiments of the present invention are described with reference to the drawings. FIG. 1 shows a structure of an LED illumination system according to a first embodiment. The LED illumination system shown in FIG. 1 includes: a phase control type of light adjuster 2; a diode bridge DB1; an LED module 3; and an LED drive circuit 4. The LED drive circuit 4 has: an LED electric-current control circuit 5; an impedance adjustment signal generation portion 6; and an electric-current subtraction portion 7. In the LED illumination system shown in FIG. 1, an a.c. power supply 1, the phase control type of light adjuster 2, the diode bridge DB1, the LED electric-current control circuit 5, and the LED module 3 including one or more LEDs are connected in series with each other; and the impedance adjustment signal generation portion 6 and the electric-current subtraction portion 7 are disposed between the diode bridge DB1 and the LED electric-current control circuit 5.

In the phase control type of light adjuster 2, if a knob (not shown) of a semi-fixed resistor Rvar1 is set at a position, a TRIAC Tri1 is turned on at a phase angle that corresponds to the set position. Further, in the phase control type of light adjuster 2, a noise prevention circuit formed of a capacitor C1 and an inductor L1 is disposed; and terminal noise, which returns from the phase control type of light adjuster 2 to a power-supply line, is reduced by the noise prevention circuit. Besides, the LED electric-current control circuit 5 is a circuit portion that prevents more than a predetermined electric current from flowing in the LED module 3.

The electric current subtraction portion 7 as an adjustment portion subtracts an electric current from an electricity supply line LN1 that supplies an LED drive electric current to the LED module 3.

To automatically detect an impedance during a time the phase control type of light adjuster 2 is in an off time, the impedance adjustment signal generation portion 6 detects an input voltage to the LED drive circuit 4 when the a.c. power supply 1 has an instantaneous value of 10 V (here, the off time of the phase control type of light adjuster 2 means that the TRIAC Tri1, which is an electric-current hold means in an inside of the phase control type of light adjuster 2, is in an off time.). Here, when the phase control type of light adjuster 2 is in the off state, the 10 V is not limiting.

Figure 2:
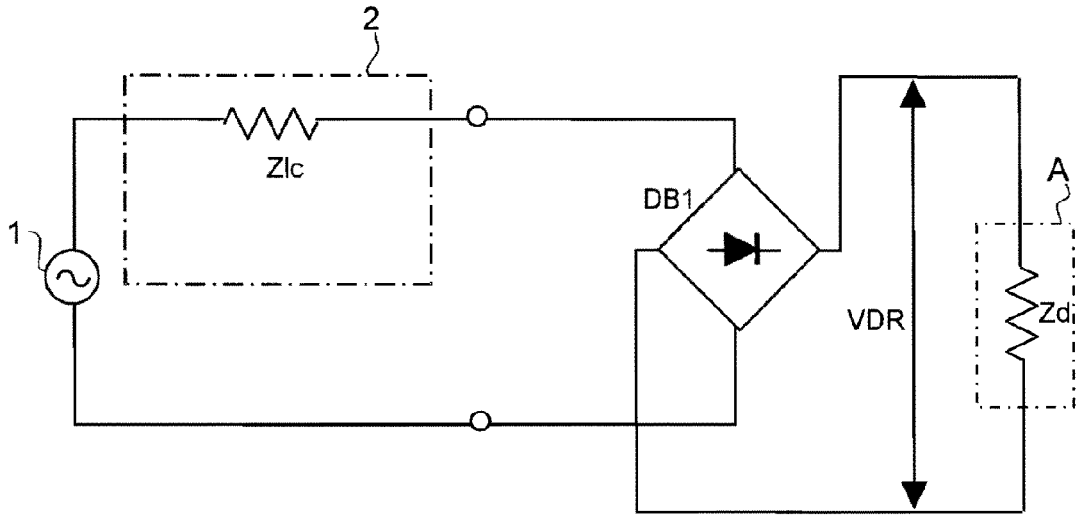
FIG. 2 is a view showing, by means of an impedance, a phase control type of light adjuster and a portion which includes an LED drive circuit and an LED module in the LED illumination system according to the first embodiment.

FIG. 2 shows, by means of an impedance, the phase control type of light adjuster 2 and a portion A which includes the LED drive circuit 4 and the LED module 3. If the impedance adjustment signal generation portion 6 detects an output voltage VDR from the diode bridge DB1 when the a.c. power supply 1 has the instantaneous value of 10 V, the impedance adjustment signal generation portion 6 uses a formula (1) to calculate an impedance during the off time the phase control type of light adjuster 2. Here, when the TRIAC Tri1 is in the off state, an electric current flows via the capacitor C1. The impedance of the phase control type of light adjuster 2 during the off time is substantially equal to the impedance of the capacitor C1.

$$Z1c=(10-VDR)/VDR\times Zd \quad (1)$$

where Z1*c*: the impedance of the phase control type of light adjuster 2, Zd: the impedance (predetermined value) of the portion A (FIG. 2), VDR: the output voltage from the diode bridge DB1.

And, the impedance adjustment signal generation portion 6 generates an adjustment signal in accordance with the calculated impedance during the off time of the phase control type of light adjuster 2. For example, if the impedance is 20 kΩ, an adjustment signal of 2.0 V is generated; if the impedance is 40 KΩ, an adjustment signal of 1.0 V is generated. The adjustment signal may be decided with reference to a table that defines a range of the impedance, or may be successively decided by means of a numerical formula.

Here, the adjustment signal may be generated at every period of the a.c. power supply, or may be generated at the first period only and held for later. Besides, the adjustment signal may be stored into a nonvolatile external storage device (EEPROM and the like). According to this, it becomes unnecessary to detect the impedance every time and it is possible to prevent an influence due to fluctuation of the detection.

The electric current subtraction portion 7, in accordance with the adjustment signal that is generated and output from the impedance adjustment signal generation portion 6, subtracts an electric current from the electricity supply line LN1 by using a MOS transistor (not shown) during the off time of the phase control type of light adjuster 2. For example, if the adjustment signal is 2.0 V, a subtraction amount of 10 mA is subtracted; if the adjustment signal is 1.0 V, a subtraction amount of 5 mA is subtracted. In other words, the smaller the calculated impedance during the off time of the phase control type of light adjuster 2 is, the larger the electric-current subtraction amount is. If the voltage applied to the LED drive circuit 4 is 50 V, the impedance of the portion A (FIG. 2) formed of the LED drive circuit 4 and the LED module 3 is as follows: 50 V/10 mA=5 kΩ, 50 V/5 mA=10 kΩ. According to this, it is possible to make the impedance of the portion A (FIG. 2) formed of the LED drive circuit 4 and the LED module 3 smaller than the impedance of the phase control type of light adjuster 2 during the off time; and reduce erroneous operation of the phase control type of light adjuster 2. If the impedance of the portion A (FIG. 2) formed of the LED drive circuit 4 and the LED module 3 is high, the voltage is not applied to the phase control type of light adjuster 2 and the TRIAC Tri1 is not turned on, so that a relationship between the light adjustment knob setting and the phase angle of the phase control type of light adjuster 2 is likely to deviate.

Here, to reduce the erroneous operation, it is desirable that the electric-current subtraction amount is made large and the impedance of the portion A (FIG. 2) is made as small as possible; however, an electric current, which does not contribute to light emission of the LED, is flown, so that it is necessary to reduce the subtraction electric current to a smallest possible limit in terms of the power supply efficiency.

Figure 3:
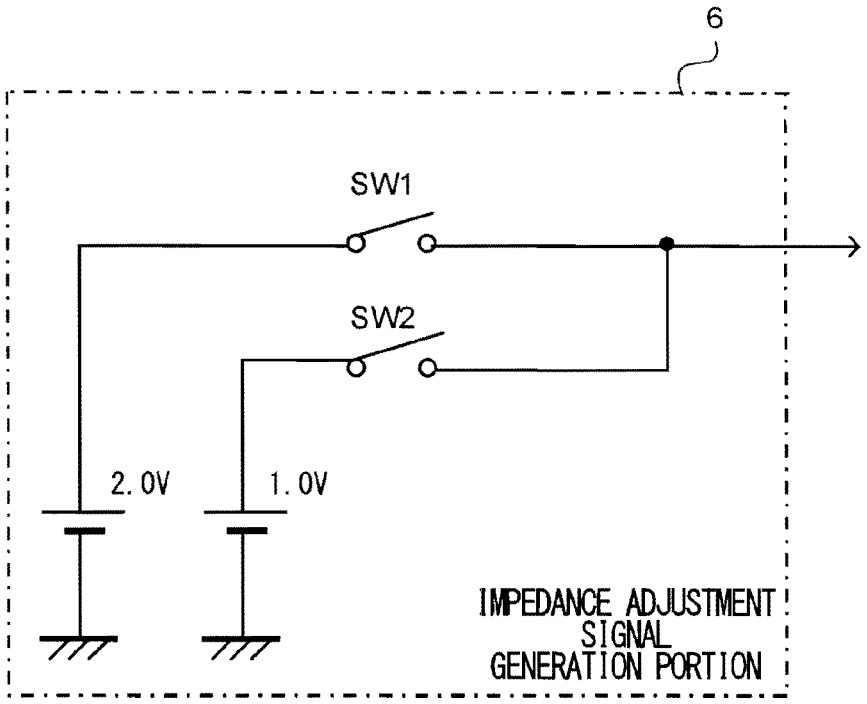
FIG. 3 is a view showing a modification of the first embodiment of the present invention.

Besides, in the first embodiment, the impedance adjustment portion 6 may also be structured as shown in FIG. 3. The impedance of the phase control type light adjuster 2 depends on an element; for example, in a case where the LED drive circuit 4 is connected to the phase control type of light adjuster 2 that has the impedance of 20 kΩ during the off time, a user turns on a switch SW1 and turns off a switch SW2 to generate the adjustment signal of 2.0 V; in a case where the LED drive circuit 4 is connected to the phase control type of light adjuster 2 that has the impedance of 40 kΩ during the off time, the user turns off the switch SW1 and turns on the switch SW2 to generate the adjustment signal of 1.0 V.

Second Embodiment

Figure 4:
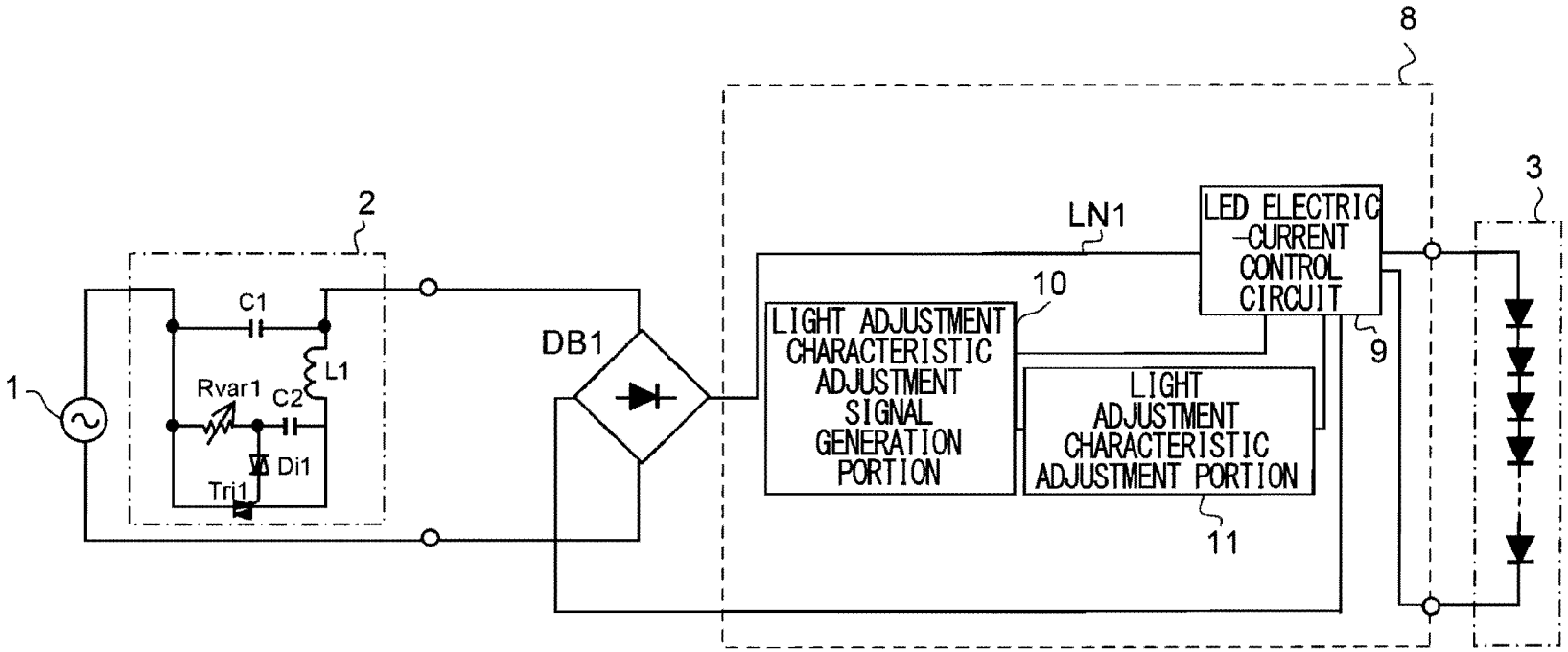
FIG. 4 is a view showing a structure of an LED illumination system according to a second embodiment of the present invention.

FIG. 4 shows a structure of an LED illumination system according to a second embodiment. In the LED illumination system shown in FIG. 4, an LED drive circuit 8 includes: an LED electric-current control circuit 9; a light adjustment characteristic adjustment signal generation portion 10; and a light adjustment characteristic adjustment portion 11.

Figure 5:
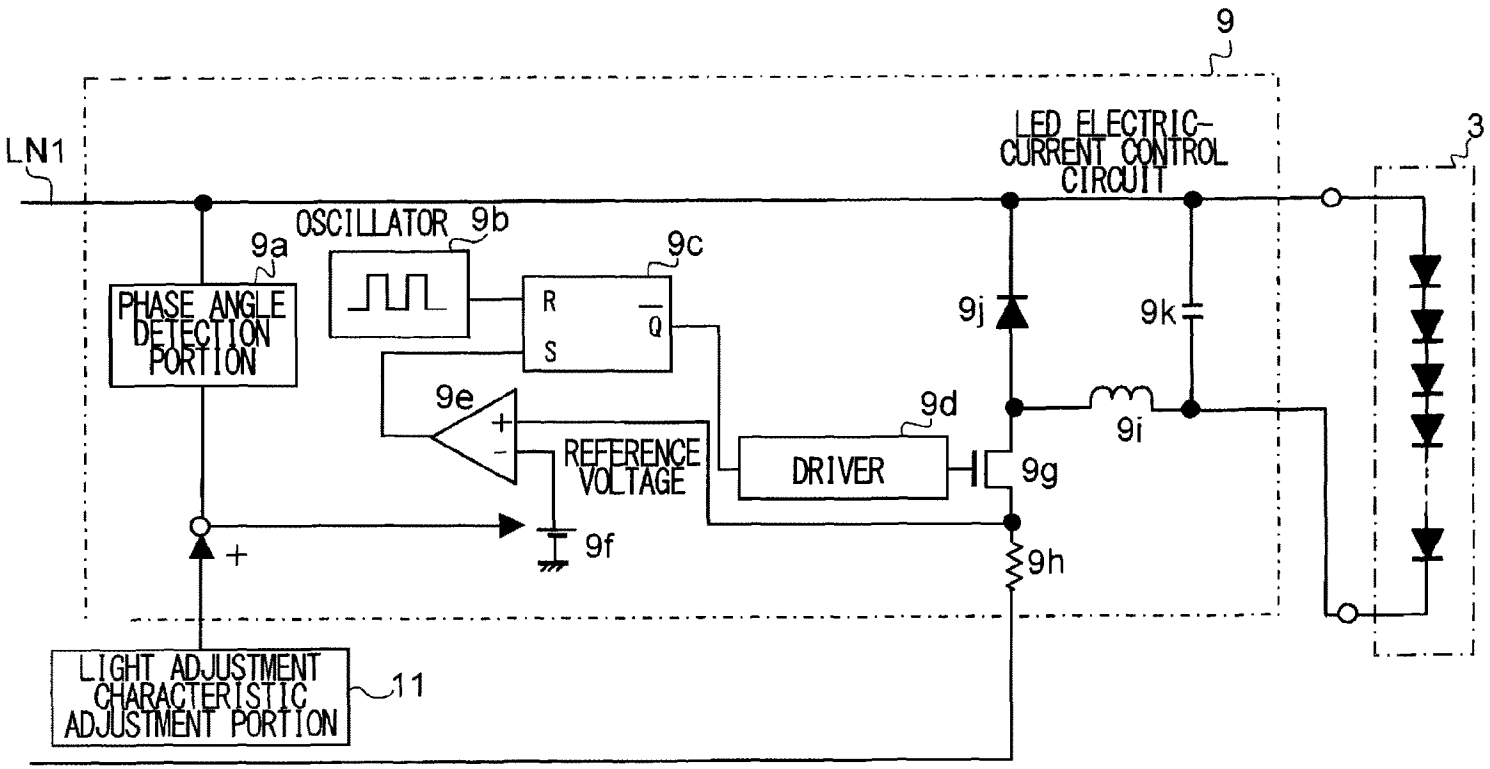
FIG. 5 is a view showing a structure of an LED electric-current control circuit in the second embodiment of the present invention.

FIG. 5 shows a structure of the LED electric-current control circuit 9. The LED electric-current control circuit 9 has: a phase angle detection portion 9*a*; an oscillator 9*b*; a flip-flop 9*c*; a driver 9*d*; a comparator 9*e*; a reference voltage 9*f*; a power MOS 9*g*; an electric-current detection resistor 9*h*; an inductor 9*i*; a diode 9*j*; and a capacitor 9*k*. The oscillator 9*b* goes to a high level, whereby the flip-flop 9*c* is reset; a $\overline{Q}$ output goes to the high level; the power MOS 9*g* is turned on; and an electric current flows. If a voltage occurring across the electric-current detection resistor 9*h* reaches the reference voltage 9*f*, the flip-flop 9*c* is set, whereby the power MOS 9*g* is turned off. To perform the light adjustment by electric power adjustment, the reference voltage 9*f* is set in accordance with a phase angle that is detected by the phase angle detection portion 9*a*. Besides, the detected value by the phase angle detection portion 9*a* is adjusted by the light adjustment characteristic adjustment portion 11.

The light adjustment characteristic adjustment signal generation portion 10 is provided with a switch (not shown) that is able to be pushed by the user. If this switch is pushed, the light adjustment characteristic adjustment signal generation portion 10 smooths the input voltage to the LED drive circuit 8 at that time; and stores an adjustment signal, which has a correlation with the smoothed input voltage, into a nonvolatile storage device (not shown). The smoothed input voltage to the LED drive circuit 8 indicates a phase angle.

Figure 6:
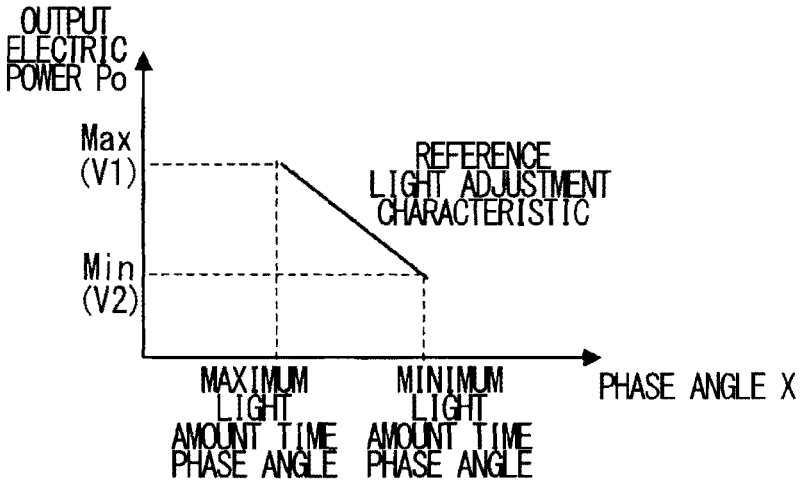
FIG. 6 is a view showing a reference light adjustment characteristic.

FIG. 6 shows a reference light adjustment characteristic that indicates a correlation between the phase angle and the output power for the LED module 3. If the switch is pushed with the phase control type of light adjuster 2 set at the maximum light amount time phase angle (minimum phase angle), the light adjustment characteristic adjustment signal generation portion 10 smooths the input voltage to the LED drive circuit 8; detects the maximum light amount time phase angle from the smoothed input voltage; and generates an adjustment signal V1 that indicates an output electric power which corresponds to the detected maximum light amount time phase angle in the reference light adjustment characteristic. Likewise, If the switch is pushed with the phase control type of light adjuster 2 set at the minimum light amount time phase angle (maximum phase angle), the light adjustment characteristic adjustment signal generation portion 10 generates an adjustment signal V2 (FIG. 6). The adjustment signals V1,V2 are overwritten in turn every time the switch is pushed.

Figure 7:
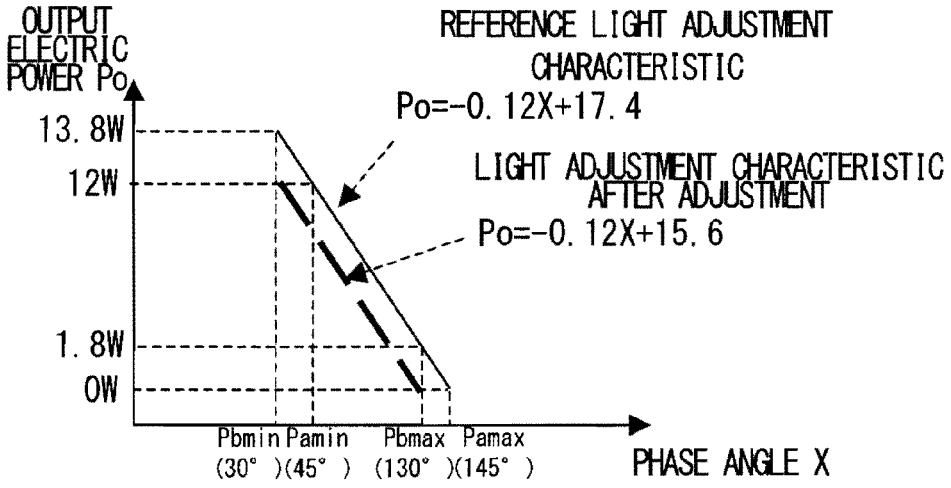
FIG. 7 is a view showing an adjustment example of a light adjustment characteristic.

FIG. 7 shows an example of the reference light adjustment characteristic. In a case where a light adjuster A, which has the minimum phase angle 45° and the maximum phase angle 145°, is connected as the phase control type of light adjuster 2, it is assumed that the output electric power for the LED module 3 is 12 W for the minimum phase angle while the output electric power is 0 W for the maximum phase angle.

In this case, in the light adjustment characteristic, Po=−0.12X+17.4 (Po: output electric power, X: phase angle), and this is use as the reference light adjustment characteristic.

Here, in a case where another light adjuster B, which has the minimum phase angle 30° and the maximum phase angle 130°, is connected, in the reference light adjustment characteristic, the output electric power for the LED module 3 becomes 13.8 W for the minimum phase angle while the output electric power becomes 1.8 W for the maximum phase angle. Accord to this, the brightness of the LED at the minimum phase angle becomes too bright compared with the case of the light adjuster A, while the brightness of the LED at the maximum phase angle does not become sufficiently dark. Because of this, it is necessary to adjust the light adjustment characteristic such that the output electric power becomes 12 W for the minimum phase angle 30° and the output electric power becomes 0 W for the maximum phase angle 130° (a broken line portion in FIG. 7).

The light adjustment characteristic adjustment portion 11 receives the above adjustment signals V1, V2 from the light adjustment characteristic adjustment signal generation portion 10; and detects the minimum phase angle and the maximum phase angle from the adjustment signals V1, V2 and the reference light adjustment characteristic (30° and 130° in the example of FIG. 7). And, the light adjustment characteristic adjustment portion 11 obtains a light adjustment characteristic such that the output electric power becomes the predetermined maximum output electric power (12 W in the example of FIG. 7) for the detected minimum phase angle while the output electric power becomes the predetermined minimum output electric power (0 W in the example of FIG. 7) for the detected maximum phase angle. In the light adjustment characteristic after this adjustment, Po=−0.12 X+15.6 in the example of FIG. 7. And, the light adjustment characteristic adjustment portion 11 adjusts the value detected by the phase angle detection portion 9*a* such that the obtained light adjustment characteristic is achieved. According to this, irrespective of the connected phase control type of light adjuster 2, it is possible to make the light adjustment characteristic appropriate.

Figure 8:
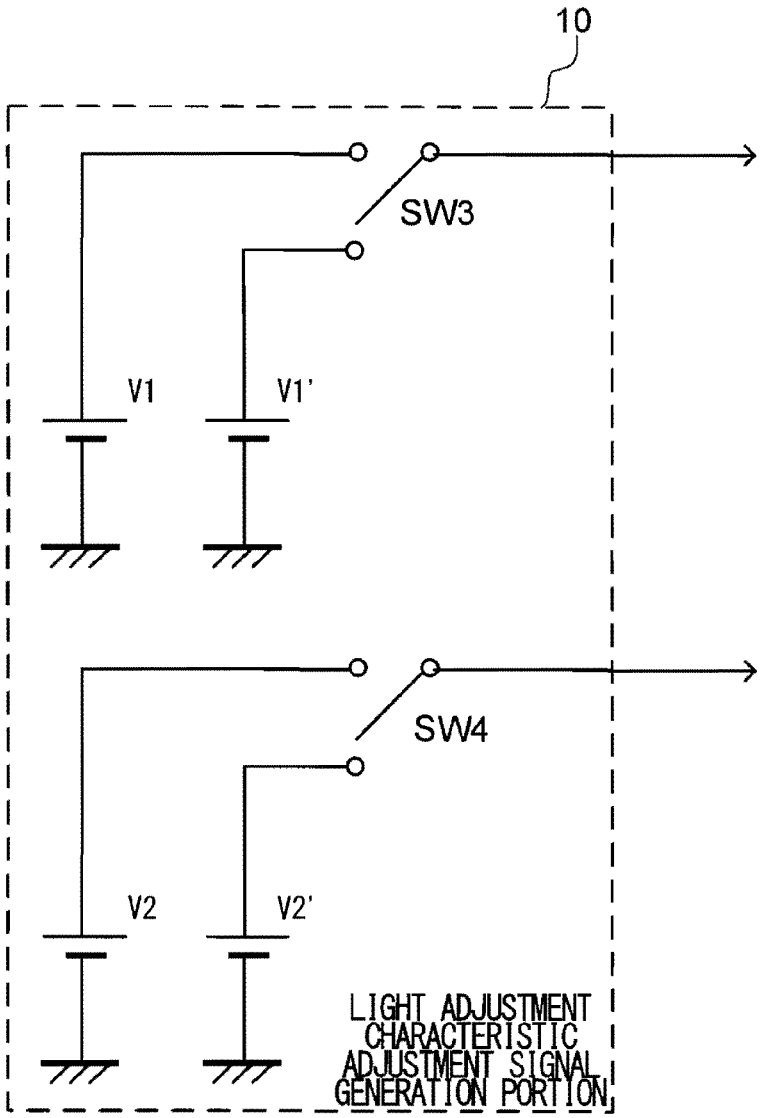
FIG. 8 is a view showing a modification of the second embodiment of the present invention.

Besides, in the second embodiment, the light adjustment characteristic adjustment signal generation portion 10 may also be structured as shown in FIG. 8. For example, in a case where the LED drive circuit 8 is connected to the phase control type of light adjuster 2 which has the minimum phase angle 45° and the maximum phase angle 145°, the user changes a switch SW3 to the voltage V1 and changes a switch SW4 to the voltage V2 to generate the adjustment signals of the voltages V1, V2; in a case where the LED drive circuit 8 is connected to the phase control type of light adjuster 2 which has the minimum phase angle 30° and the maximum phase angle 130°, the user changes the switch SW3 to a voltage V1' and changes the switch SW4 to a voltage V2' to generate the adjustment signals of the voltages V1', V2'.

Third Embodiment

Figure 9:
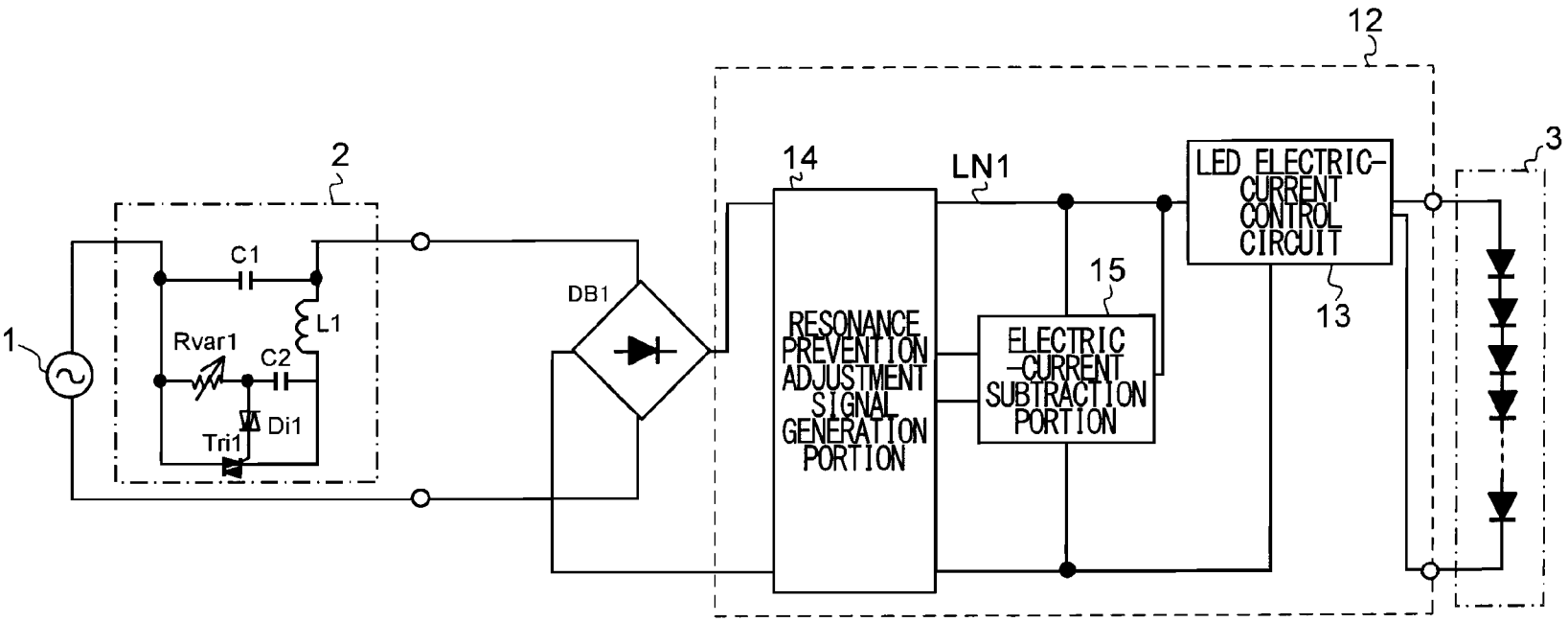
FIG. 9 is a view showing a structure of an LED illumination system according to a third embodiment of the present invention.
Figure 10:
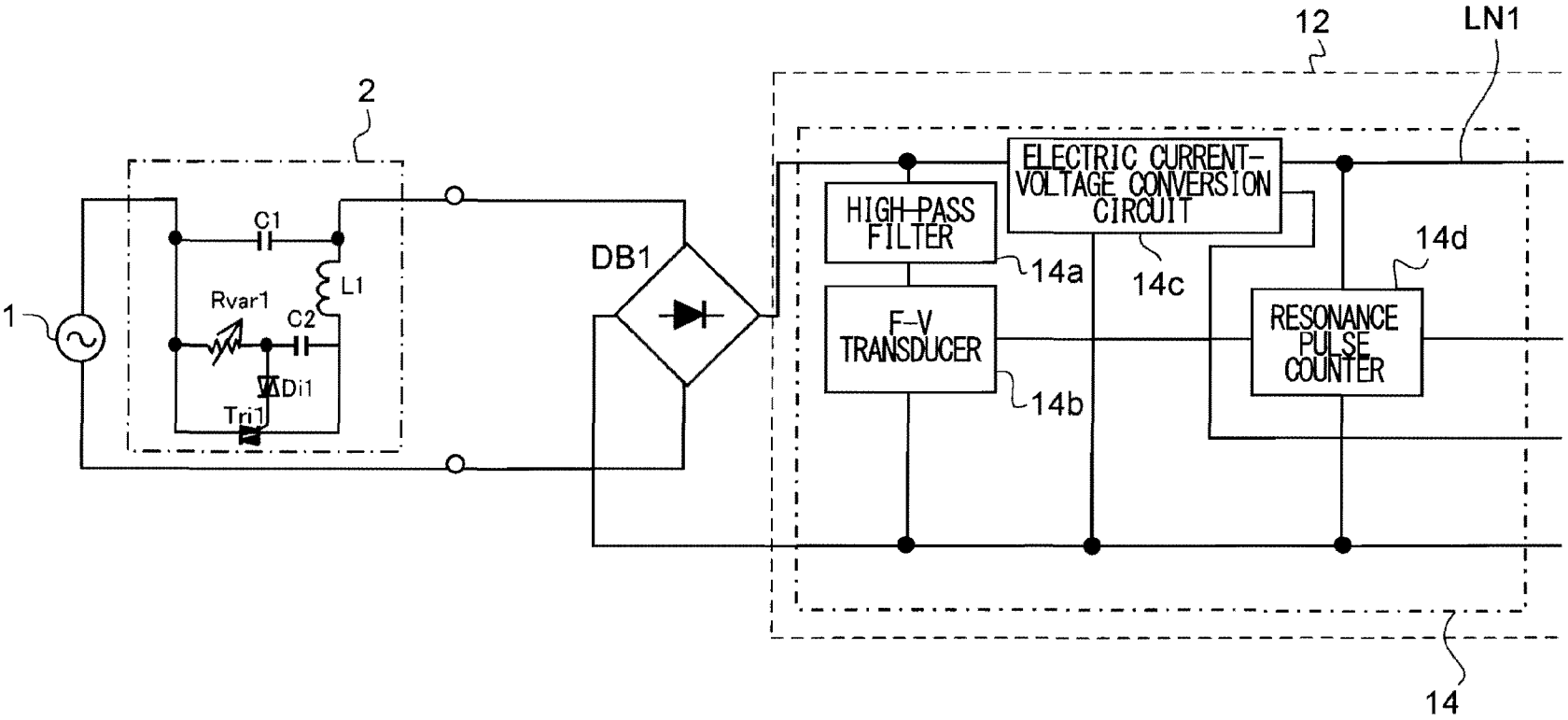
FIG. 10 is a view showing a structure of a resonance prevention adjustment signal generation portion in the third embodiment of the present invention.

FIG. 9 shows a structure of an LED illumination system according to a third embodiment. In the LED illumination system shown in FIG. 9, an LED drive circuit 12 includes: an LED electric-current control circuit 13; a resonance prevention adjustment signal generation portion 14; and an electric-current subtraction portion 15. Besides, FIG. 10 shows a structure of the resonance prevention adjustment signal generation portion 14. The resonance prevention adjustment signal generation portion 14 includes: a high-pass filter 14*a*; an F-V transducer 14*b*; an electric current-voltage conversion circuit 14*c*; and a resonance pulse counter 14*d*.

Figure 11:
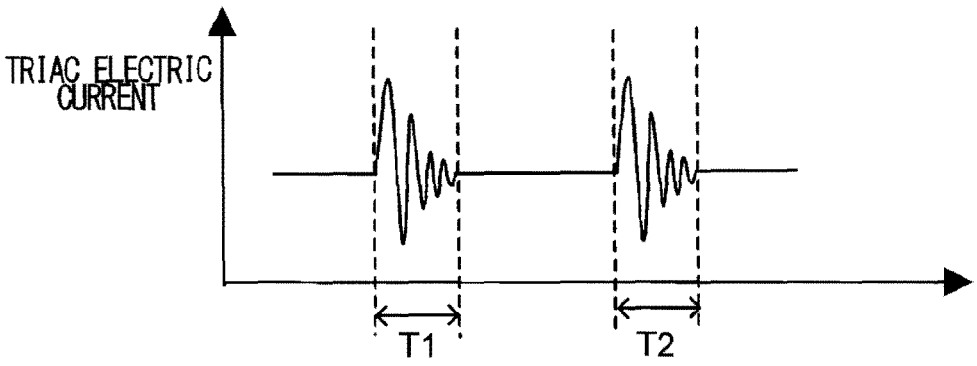
FIG. 11 is a view showing a resonance example of a TRIAC electric current.

The resonance prevention adjustment signal generation portion 14 detects an amplitude, a frequency, and a resonance pulse number from a portion where a TRIAC electric current resonates. FIG. 11 shows a waveform example of the TRIAC electric current. In FIG. 11, resonances occur at periods T1, T2. When the TRIAC Tri1 is turned on, such resonances occur.

As for the amplitude, the electric current-voltage conversion circuit 14*c* converts an electric current flowing in the electricity supply line LN1 into a voltage; thereafter, outputs an adjustment signal (first adjustment signal) that correlates with the electric current amplitude. Besides, the F-V transducer 14*a* transduces a resonance frequency of a high-frequency component, which is extracted from the input voltage to the LED drive circuit 12 by the high-pass filter 14*a*, into a voltage (the resonance frequency is from a few kilohertz to tens of kilohertz). And, the resonance pulse counter 14*d* counts resonance pulses of the high-frequency component that is extracted from the input voltage to the LED drive circuit 12 by the high-pass filter 14*a*; and outputs an adjustment signal (second adjustment signal) that has a voltage obtained by dividing the number of counted resonance pulses by the voltage converted from the resonance frequency.

For example, as shown in tables 1 and 2, in a case where a light adjuster A is connected, under a condition that at the resonance portion of the TRIAC electric current, the electric current amplitude is 100 mA; the resonance frequency is 10 kHz; and the resonance pulse number is 5, 0.5 V is output as the first adjustment signal; and 5 V is output as the second adjustment signal. Besides, for example, as shown in the tables 1 and 2, in a case where a light adjuster B is connected, under a condition that at the resonance portion of the TRIAC electric current, the electric current amplitude is 200 mA; the resonance frequency is 20 kHz; and the resonance pulse number is 5, 1 V is output as the first adjustment signal; and 2.5 V is output as the second adjustment signal.

TABLE 1

| | electric current amplitude [mA] | first adjustment signal [V] |
|---|---|---|
| light adjuster A | 100 | 0.5 |
| light adjuster B | 200 | 1 |

TABLE 2

| | resonance frequency [kHz] | resonance frequency voltage signal [V] | the number of resonance pulses | second adjustment signal [V] |
|---|---|---|---|---|
| light adjuster A | 10 | 1 | 5 | 5 |
| light adjuster B | 20 | 2 | 5 | 2.5 |

Here, the adjustment signal may be obtained at every period of the a.c. power supply or may be obtained and held when the voltage is applied to the LED electric-current drive circuit 12. Besides, the adjustment signal may be stored into a nonvolatile external storage device.

The electric-current subtraction portion 15 decides an electric-current subtraction amount in accordance with the first adjustment signal received from the resonance prevention adjustment signal generation portion 14; decides an electric-current subtraction time in accordance with the second adjustment signal received from the resonance prevention adjustment signal generation portion 14; and uses the decided electric-current subtraction amount and electric-current subtraction time to subtract an electric current from the electricity supply line LN1 by means of the MOS transistor (not shown) starting at timing the TRIAC Tri1 is turned on. For example, in the case where the light adjuster A is connected, the first adjustment signal 0.5 V is received and the subtraction amount is decided on 100 mA; the second adjustment signal 5 V is received and the subtraction time is decided on 0.5 ms. Besides, in the case where the light adjuster B is connected, the first adjustment signal 1 V is received and the subtraction amount is decided on 200 mA; the second adjustment signal 2.5 V is received and the subtraction time is decided on 0.25 ms. The subtraction electric-current amount and subtraction time may be decided with reference to a table that defines a range of the adjustment signal, or may be successively decided by means of a numerical formula. According to this, even if any phase control type of light adjuster 2 is connected, it is possible to reduce the flicker of the LED and increase the efficiency by curbing the resonance of the TRIAC electric current that occurs at the time the TRIAC Tri1 is turned on.

Figure 12:
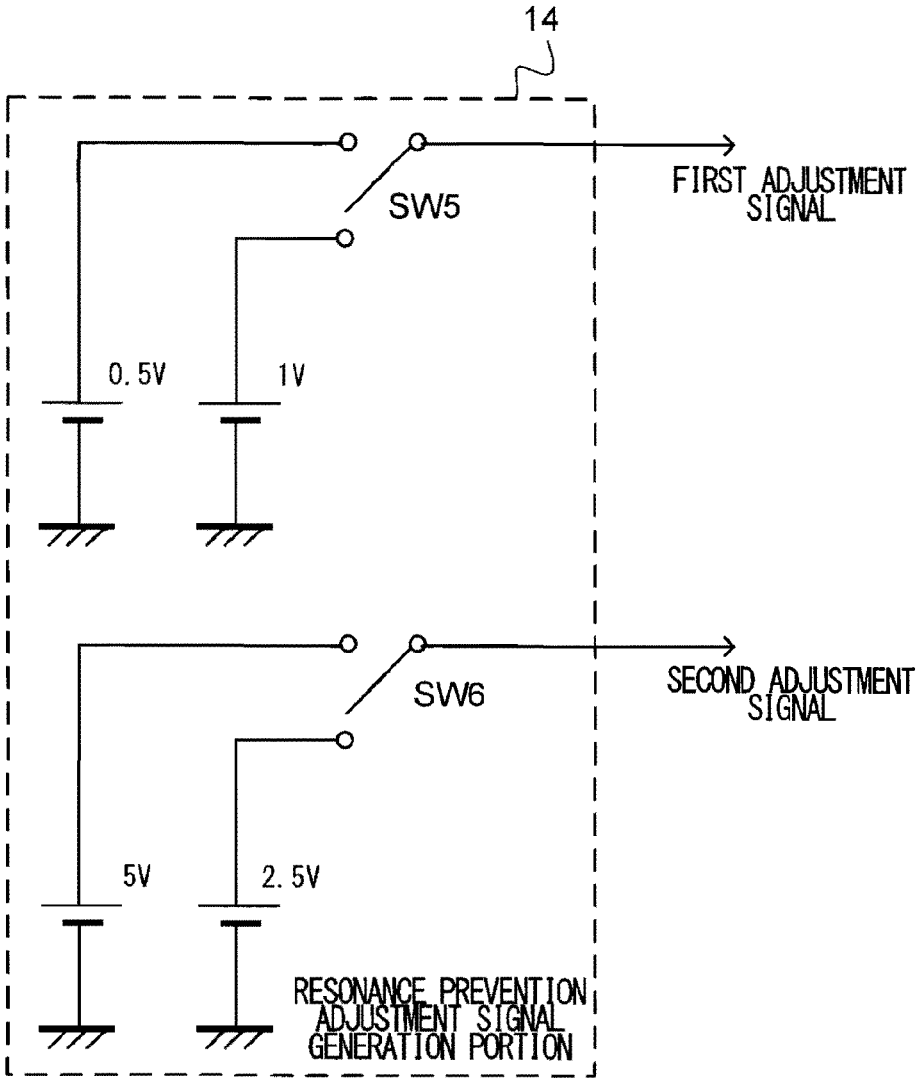
FIG. 12 is a view showing a modification of the third embodiment of the present invention.

Besides, in the third embodiment, the resonance prevention adjustment signal generation portion 14 may also be structured as shown in FIG. 12. For example, in a case where the resonance prevention adjustment signal generation portion 14 is connected to the light adjuster A, the user changes a switch SW5 to a voltage of 0.5 V and changes a switch SW6 to a voltage of 5 V to generate the first adjustment signal of 0.5 V and the second adjustment signal of 5 V; in a case where the resonance prevention adjustment signal generation portion 14 is connected to the light adjuster B, the user changes the switch SW5 to a voltage of 1 V and changes the switch SW6 to a voltage of 2.5 V2 to generate the first adjustment signal of 1 V and the second adjustment signal of 2.5 V.

Fourth Embodiment

Figure 13:
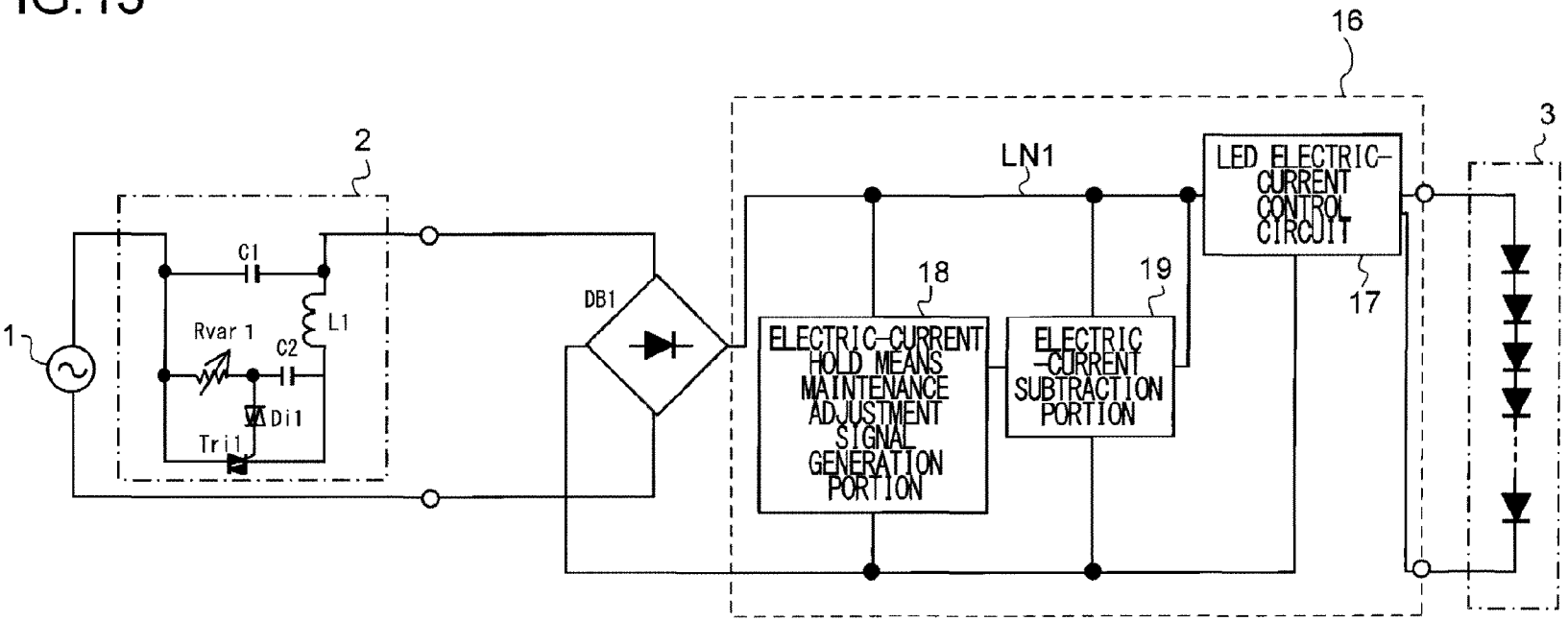
FIG. 13 is a view showing a structure of an LED illumination system according to a fourth embodiment of the present invention.

FIG. 13 shows a structure of an LED illumination system according to a fourth embodiment. An LED drive circuit 16 includes: an LED electric-current control circuit 17; an electric-current hold means maintenance adjustment signal generation portion 18; and an electric-current subtraction portion 19.

Figure 14:
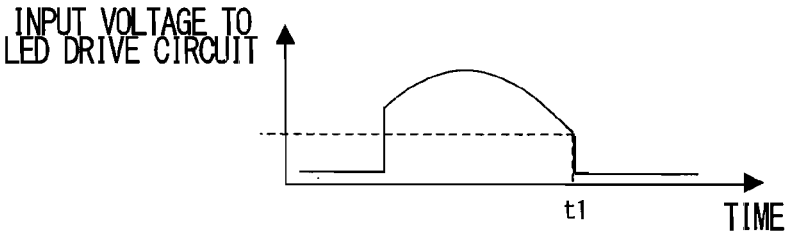
FIG. 14 is a view showing a waveform example of an LED drive circuit input voltage.

The electric-current hold means maintenance adjustment signal generation portion 18 goes into a test mode at a time an input voltage to the LED drive circuit 16 is applied to the electric-current hold means maintenance adjustment signal generation portion 18. Going into the test mode, the electric-current hold means maintenance adjustment signal generation portion 18 makes the electric-current subtraction portion 19 start to subtract an electric current from the electricity supply line LN1, and starts to monitor the input voltage to the LED drive circuit 16. The electric-current hold means maintenance adjustment signal generation portion 18 reduces the subtraction amount subtracted by the electric-current subtraction portion 19, and monitors the input voltage. In the state where the TRIAC Tri1 is kept in the on state by the electric-current subtraction, a voltage having the same waveform as the a.c. power supply is input into the LED drive circuit 16; however, if the TRIAC Tri1 is turned off thanks to the reduction of the subtraction amount, the input voltage sharply decreases (timing t1 in FIG. 14). If the electric-current hold means maintenance adjustment signal generation portion 18 detects this sharp decrease of the input voltage, the electric-current hold means maintenance adjustment signal generation portion 18 determines that the subtraction electric-current amount at that time is a hold electric-current amount of the TRIAC Tri1; generates and outputs the first adjustment signal which has a voltage corresponding to the hold electric-current amount.

For example, as shown in table 3, in the case of the light adjuster A, if the hold electric-current amount is determined to be 20 mA, the electric-current hold means maintenance adjustment signal generation portion 18 outputs the first adjustment signal of 2 V; in the case of the light adjuster B, if the hold electric-current amount is determined to be 10 mA, the electric-current hold means maintenance adjustment signal generation portion 18 outputs the first adjustment signal of 1 V.

TABLE 3

| | hold electric current [mA] | first adjustment signal [V] |
|---|---|---|
| light adjuster A | 20 | 2 |
| light adjuster B | 10 | 1 |

Besides, the electric-current hold means maintenance adjustment signal generation portion 18 in the test mode, based on the input voltage at the time the input voltage to the LED drive circuit 16 sharply decreases, calculates a time from the time the TRIAC Tri1 is turned off to the time the a.c. voltage becomes 0 V, and outputs the second adjustment signal that correlates with the calculated time.

Here, the electric-current hold means maintenance adjustment signal generation portion 18 holds the output of the adjustment signal during the time the input voltage is applied. Besides, a switch may be disposed; and at a time the switch is pushed, the electric-current hold means maintenance adjustment signal generation portion 18 may go into the test mode and store the adjustment signal into a non-volatile storage device.

The electric-current subtraction portion 19 receives the first adjustment signal from the electric-current hold means maintenance adjustment signal generation portion 18 and decides a subtraction electric-current amount, while receives the second adjustment signal and decides an electric-current subtraction time and an electric-current subtraction start voltage.

For example, if the first adjustment signal is 2 V as described above, the subtraction electric-current amount is decided on 20 mA; if the first adjustment signal is 1 V, the subtraction electric-current amount is decided on 10 mA.

The electric-current subtraction time is set at the same time as the time from the TRIAC Tri1 being turned off to the a.c. voltage becoming 0 V. The electric-current subtraction start voltage is set at $141\times\mathrm{Sin}\,(2\pi\times 50\ \mathrm{Hz}\times 0.5\ \mathrm{ms})=22$ V in a case where for example, the time from the TRIAC Tri1 being turned off to the a.c. voltage becoming 0 V is 0.5 ms and the a.c. voltage is an effective voltage of 100 V.

Figure 15:
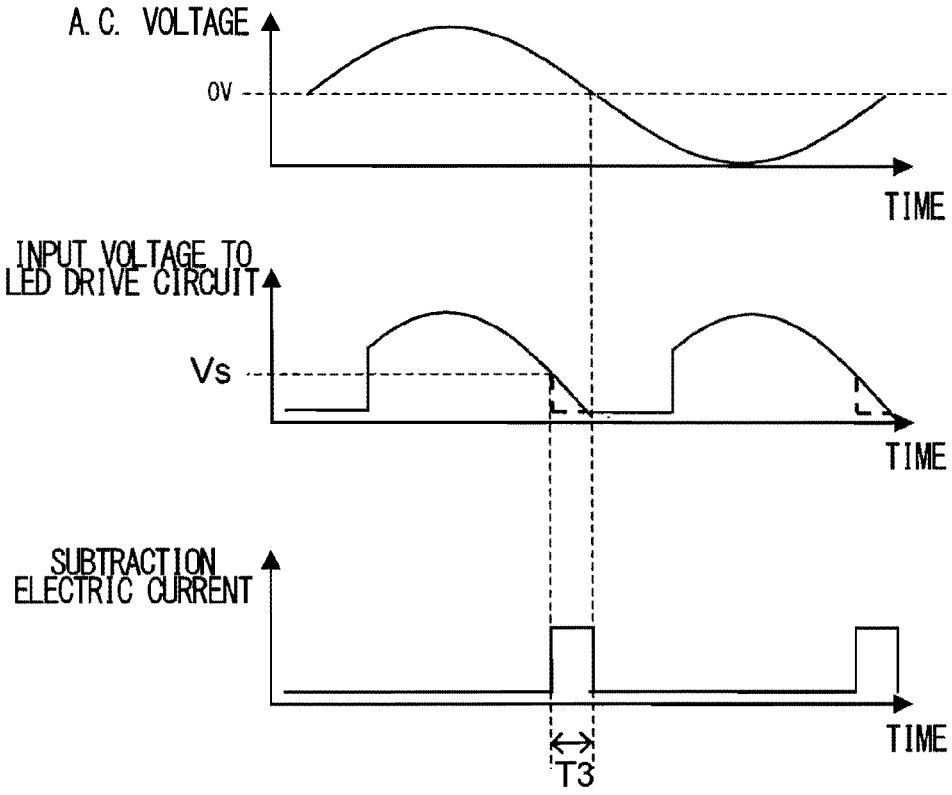
FIG. 15 is a view showing each signal waveform for indicating electric-current subtraction control.

And, the electric-current subtraction portion 19 uses the MOS transistor (not shown) to subtract an electric current from the electricity supply line LN1 in accordance with the decided subtraction electric-current amount and subtraction time starting at timing the input voltage to the LED drive circuit 16 becomes the decided electric-current start voltage. In FIG. 15, an electric current is subtracted during only a time of T3 starting at a time corresponding to an electric-current subtraction voltage Vs. According to this, it is possible to curb the flicker by means of any phase control type of light adjuster 2 and achieve the LED drive circuit that has good efficiency.

Here, according to the same structure as the above structure shown in FIG. 3, for example, in a case where the electric-current subtraction portion 19 is connected to the light adjuster A, the user may turn on the switch SW1 and turn off the switch SW2 to generate the first adjustment signal of 2.0 V; in a case where the electric-current subtraction portion 19 is connected to the light adjuster B, the user may turn off the switch SW1 and turn on the switch SW2 to generate the first adjustment signal of 1.0 V.

Embodiments Using a Photodiode

Figure 16:
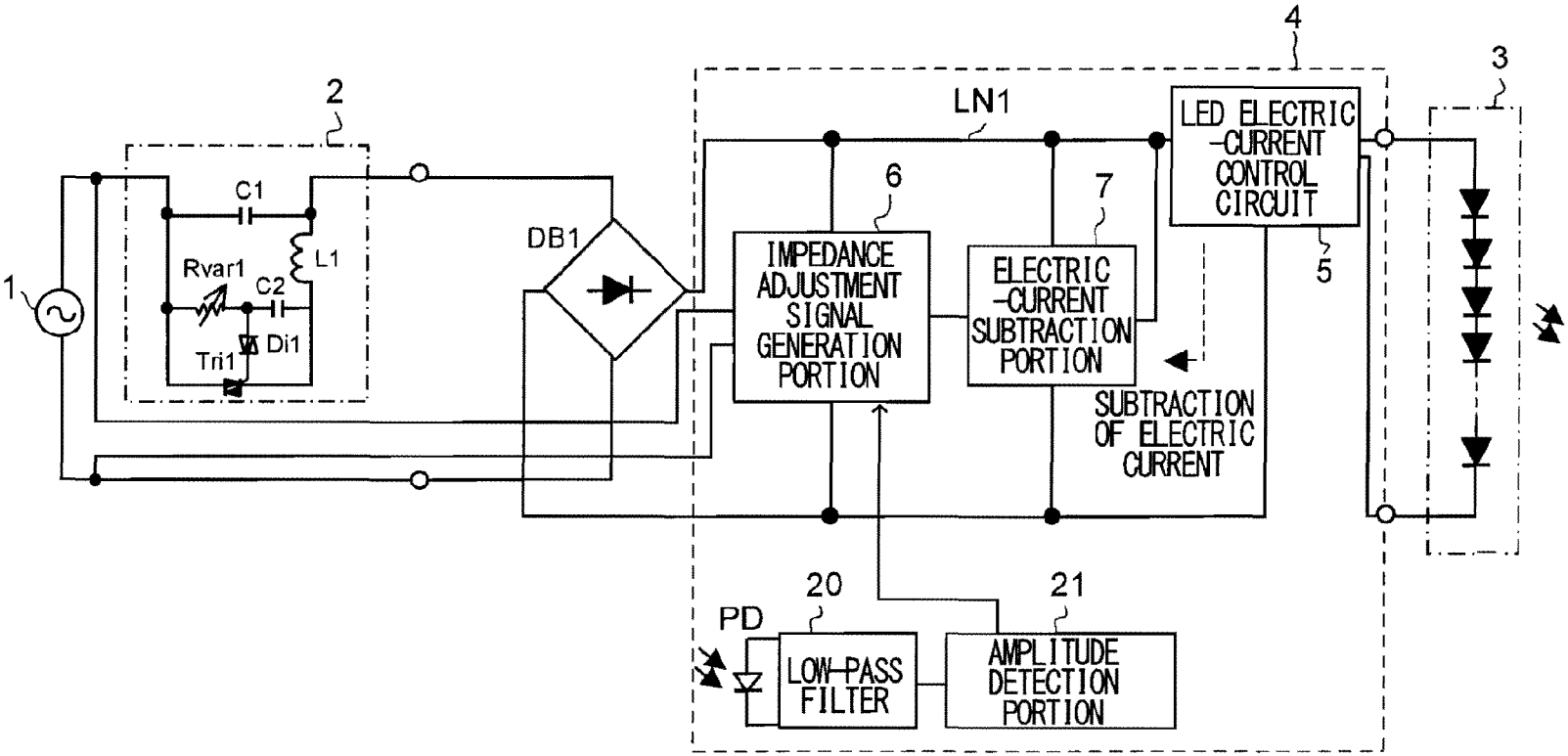
FIG. 16 is a view showing a structure of an embodiment in which a photodiode is added in the first embodiment of the present invention.

Next, embodiments, in which a photodiode is added to the above first to fourth embodiments, are described. FIG. 16 shows a structure according to an embodiment in which a photodiode is added in the first embodiment. In this embodiment, a photodiode PD, a low-pass filter 20, and an amplitude detection portion 21 are added to the LED drive circuit 4.

A state of light from the LED module 3 is detected by the photodiode PD. A visible flicker has a frequency of about 30 Hz or below; accordingly, the low-pass filter 20 having a cut frequency of about 30 Hz is used to extract a low-frequency component from an output from the photodiode PD. And, the amplitude detection portion 21 determines that a flicker occurs when the amplitude of the low-frequency component extracted by the low-pass filter 20 exceeds a predetermined value; and outputs an amplitude detection signal to the impedance adjustment signal generation portion 6. The impedance adjustment signal generation portion 6 outputs a signal, as a corrected adjustment signal, which is obtained by adding the amplitude detection signal to the occurring adjustment signal. According to this, it is possible to curb the flicker of the LED.

Figure 18:
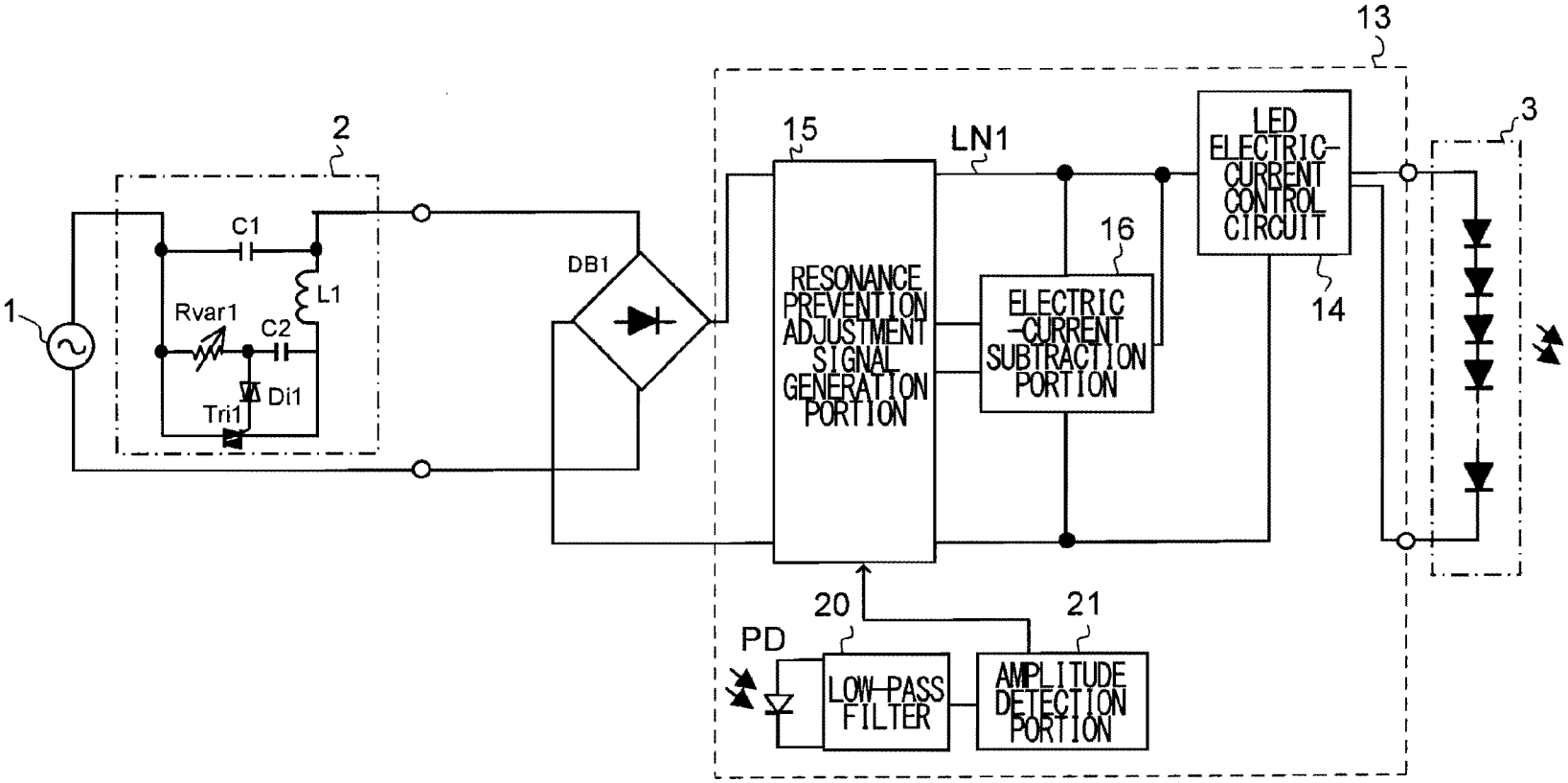
FIG. 18 is a view showing a structure of an embodiment in which a photodiode is added in the third embodiment of the present invention.
Figure 19:
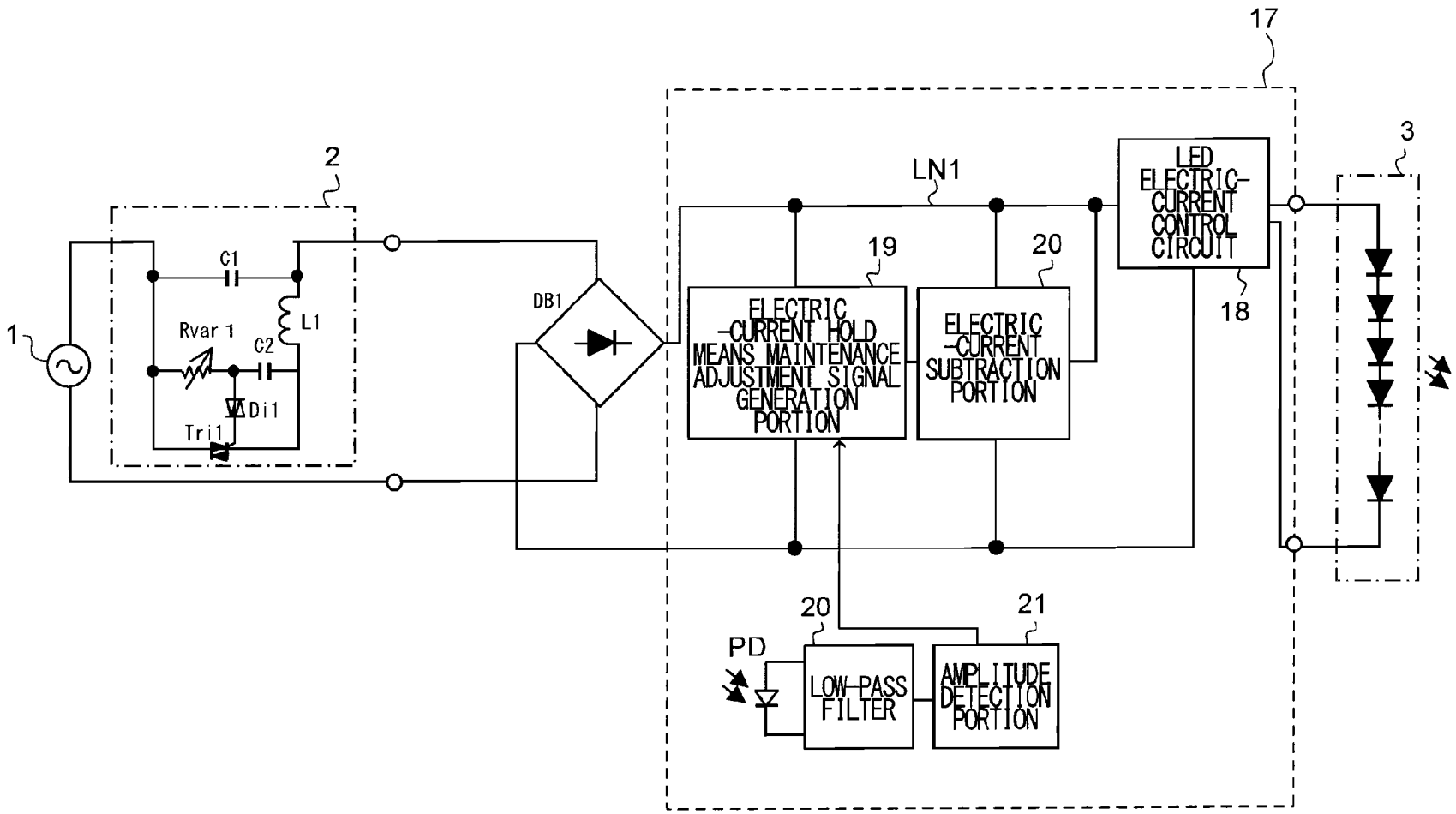
FIG. 19 is a view showing a structure of an embodiment in which a photodiode is added in the fourth embodiment of the present invention.

The same adjustment signal correction as the above correction is applied to embodiments in which a photodiode is added to the third and fourth embodiments shown in FIG. 18 and FIG. 19.

Figure 17:
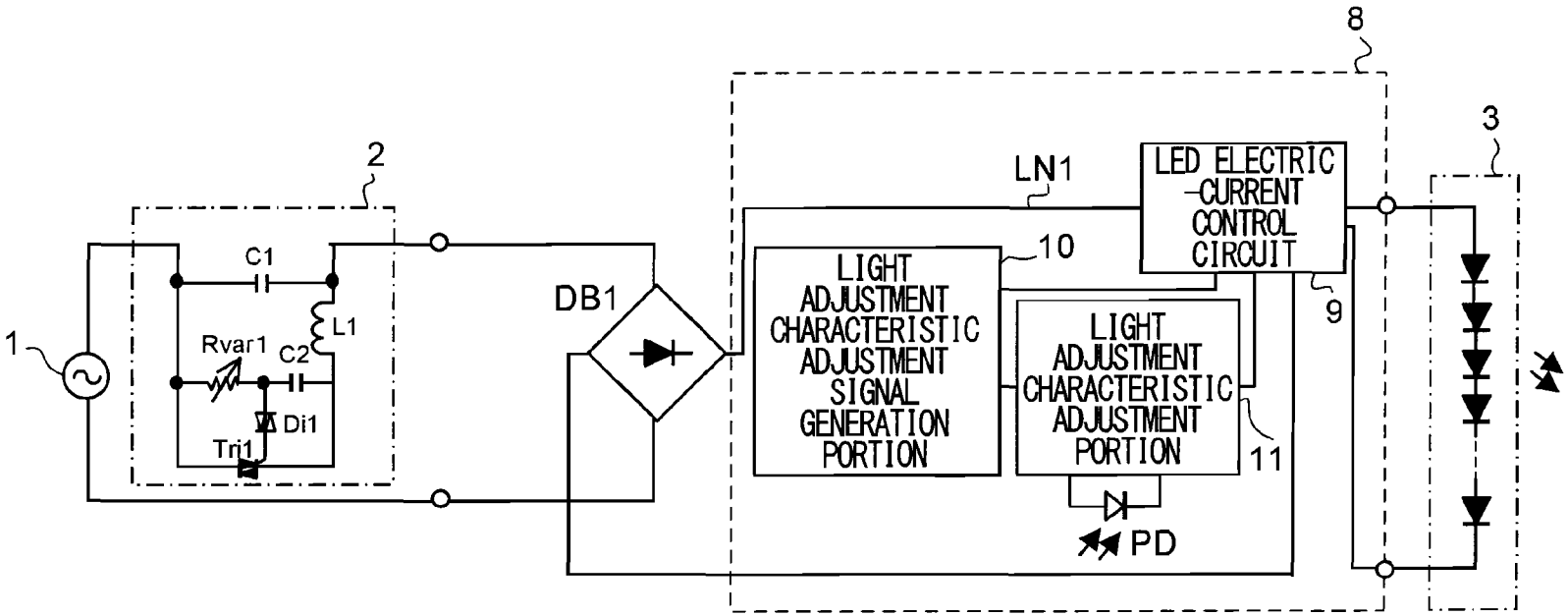
FIG. 17 is a view showing a structure of an embodiment in which a photodiode is added in the second embodiment of the present invention.

Besides, FIG. 17 shows a structure according to an embodiment in which a photodiode is added to the second embodiment. In this embodiment, the light adjustment characteristic adjustment portion 11, from an electric current flowing in the photodiode PD, calculates an output electric power for the LED module 3; and based on the calculated output electric power, adjusts the value detected by the phase angle detection portion 9*a* (FIG. 5) of the LED electric-current control circuit 9. According to this, the calculated output electric power is so controlled as to equal a target electric power, so that a better light adjustment characteristic is obtained.

Another Embodiment

Figure 20:
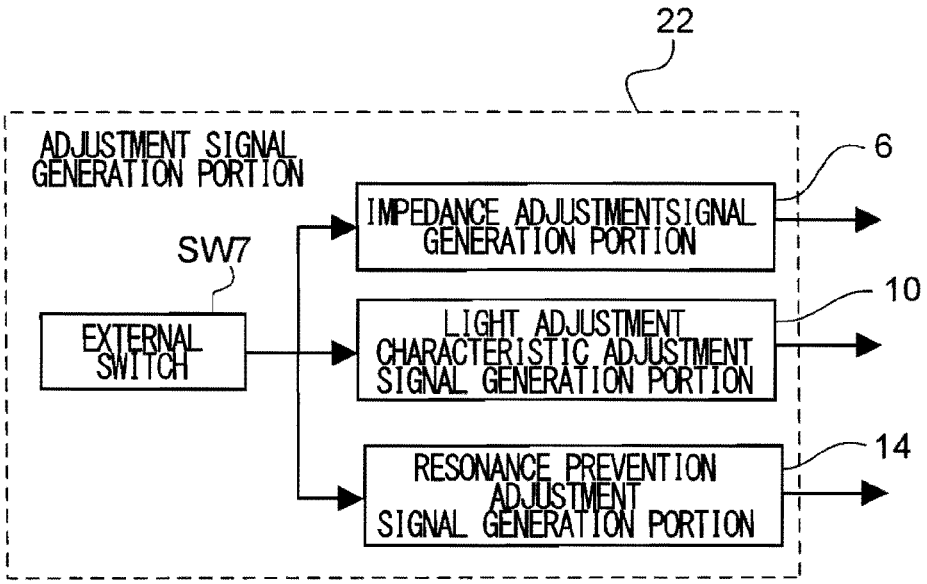
FIG. 20 is a view showing a structure of an embodiment which changes a combination of adjustment signals by means of an external switch.

As the adjustment signal generation portion, as shown in FIG. 20, an adjustment signal generation portion 22 may be used which has: an external switch SW7; the impedance adjustment signal generation portion 6; the light adjustment characteristic adjustment signal generation portion 10; and the resonance prevention adjustment signal generation portion 14. In this embodiment, in accordance with a connected light adjuster, the user uses the external switch SW7 to change a combination of the respective adjustment signals that are output from the impedance adjustment signal generation portion 6, the light adjustment characteristic adjustment signal generation portion 10, and the resonance prevention adjustment signal generation portion 14. According to this, even if any phase control type of light adjuster is connected, it is possible to perform the adjustment of the light adjustment characteristic and the flicker at a time and easily.

Here, as an LED illumination apparatus that has the LED drive circuit according the above-described embodiments, there are an LED light bulb and the like that include, for example, the diode bridge, the LED drive circuit, and the LED module.

What is claimed is:

1. An LED drive circuit that is connectable to one of a plurality of kinds of phase control type light adjusters which have different characteristic values about a same kind of characteristic and receives a voltage based on an AC voltage to drive an LED load, the LED drive circuit comprising:

an adjustment signal generation portion that generates an adjustment signal in accordance with a characteristic of a phase control type of light adjuster which is connected to the LED drive circuit; and an adjustment portion that receives the adjustment signal to adjust a characteristic for driving the LED load, wherein the adjustment signal generation portion detects the characteristic value of a connected one phase control type of light adjuster of the plurality of kinds of phase control type light adjusters and generates an adjustment signal in accordance with a result of the detection, wherein the adjustment signal generation portion includes an external switch, changes and generates a combination of respective adjustment signals in accordance with a plurality of kinds of characteristics of the connected phase control type of light adjuster by operating the external switch.

2. The LED drive circuit according to claim 1, wherein the adjustment signal generation portion calculates an impedance, as said characteristic value, at an off time of the phase control type of light adjuster and generates an adjustment signal that has a voltage in accordance with the calculated impedance.

3. The LED drive circuit according to claim 2, wherein during a time the phase control type of light adjuster is in an off state, the adjustment portion subtracts an electric current from an electricity supply line, which supplies a driving electric current to the LED load, by an electric-current subtraction amount in accordance with the adjustment signal received from the adjustment signal generation portion.

4. The LED drive circuit according to claim 1, wherein the adjustment signal generation portion generates an adjustment signal in accordance with a maximum light amount time phase angle and a minimum light amount time phase angle as said characteristic value of the phase control type of light adjuster, wherein the adjustment portion obtains a relational formula between a phase angle and an output electric power in which the output electric power for the LED load corresponding to the maximum light amount time phase angle becomes a predetermined maximum output electric power and the output electric power for the LED load corresponding to the minimum light amount time phase angle becomes a predetermined minimum output electric power and adjusts a light adjustment characteristic in accordance with the obtained relational formula.

5. The LED drive circuit according to claim 1, wherein the adjustment signal generation portion generates an adjustment signal in accordance with at least one of an amplitude, a resonance frequency, a resonance pulse number at a portion where an electric current of an electric-current hold portion of the phase control type of light adjuster resonates, wherein based on the adjustment signal received from the adjustment signal generation portion, the adjustment portion decides at least one of an electric-current subtraction amount and an electric-current subtraction time; and based on a decision result, subtracts an electric current from an electricity supply line for supplying a driving electric current to the LED load starting at timing the phase control type of light adjuster is turned on.

6. The LED drive circuit according to claim 1, wherein based on a relationship between a plurality of hold electric current values and a plurality of adjustment signal voltage values, the adjustment signal generation portion generates an adjustment signal that has a voltage in accordance with a hold electric current value of an electric-current hold portion as said characteristic value of the phase control type of light adjuster.

7. The LED drive circuit according to claim 6, wherein based on the adjustment signal received from the adjustment signal generation portion, the adjustment portion decides an electric-current subtraction amount; and based on a decision result, subtracts an electric current from an electricity supply line for supplying a driving electric current to the LED load.

8. The LED drive circuit according to claim 1, further comprising a photodiode that receives light from the LED load, a low-pass filter that extracts a low-frequency component from an output from the photodiode, and an amplitude detection portion that monitors an amplitude of the extracted low-frequency component; wherein based on an amplitude detection signal input from the amplitude detection portion, the adjustment signal generation portion generates the adjustment signal.

9. The LED drive circuit according to claim 1, wherein the adjustment signal generation portion includes an external switch, changes and generates a combination of respective adjustment signals in accordance with a plurality of kinds of characteristics of the connected phase control type of light adjuster by operating the external switch.

10. An LED illumination apparatus comprising:

an LED drive circuit according to claim 1, that is connectable to a phase control type of light adjuster and receives a voltage based on an a.c. voltage to drive an LED load, includes: an adjustment signal generation portion that generates an adjustment signal in accordance with a characteristic of a phase control type of light adjuster which is connected to the LED drive circuit; and an adjustment portion that receives the adjustment signal to adjust a characteristic for driving the LED load; and the LED load connected to an output side of the LED drive circuit.

11. An LED drive circuit that is connectable to one of a plurality of kinds of phase control type light adjusters which have different characteristic values about a same kind of characteristic and receives a voltage based on an AC voltage to drive an LED load, the LED drive circuit comprising:

an adjustment signal generation portion that generates an adjustment signal in accordance with a characteristic of a phase control type of light adjuster which is connected to the LED drive circuit; and an adjustment portion that receives the adjustment signal to adjust a characteristic for driving the LED load, wherein the adjustment signal generation portion includes an external switch, changes and generates a combination of respective adjustment signals in accordance with a plurality of kinds of characteristics of the connected phase control type of light adjuster by operating the external switch.

12. The LED drive circuit according to claim 11, wherein the adjustment signal generation portion generates an adjustment signal that has a voltage in accordance with an impedance at an off time of the phase control type of light adjuster.

13. The LED drive circuit according to claim 12, wherein during a time the phase control type of light adjuster is in an off state, the adjustment portion subtracts an electric current from an electricity supply line, which supplies a driving electric current to the LED load, by an electric-current subtraction amount in accordance with the adjustment signal received from the adjustment signal generation portion.

14. The LED drive circuit according to claim 11, wherein the adjustment signal generation portion generates an adjustment signal in accordance with a maximum light amount time phase angle and a minimum light amount time phase angle as said characteristic value of the phase control type of light adjuster, wherein wherein the adjustment portion obtains a relational formula between a phase angle and an output electric power in which the output electric power for the LED load corresponding to the maximum light amount time phase angle becomes a predetermined maximum output electric power and the output electric power for the LED load corresponding to the minimum light amount time phase angle becomes a predetermined minimum output electric power and adjusts a light adjustment characteristic in accordance with the adjustment signal received from the obtained relational formula.

15. The LED drive circuit according to claim 11, wherein the adjustment signal generation portion generates an adjustment signal in accordance with at least one of an amplitude, a resonance frequency, a resonance pulse number at a portion where an electric current of an electric-current hold portion of the phase control type of light adjuster resonates, wherein based on the adjustment signal received from the adjustment signal generation portion, the adjustment portion decides at least one of an electric-current subtraction amount and an electric-current subtraction time; and based on a decision result, subtracts an electric current from an electricity supply line for supplying a driving electric current to the LED load starting at timing the phase control type of light adjuster is turned on.

16. The LED drive circuit according to claim 11, wherein the adjustment signal generation portion generates an adjustment signal that has a voltage in accordance with a hold electric current of an electric-current hold portion of the phase control type of light adjuster.

17. The LED drive circuit according to claim 16, wherein based on the adjustment signal received from the adjustment signal generation portion, the adjustment portion decides an electric-current subtraction amount; and based on a decision result, subtracts an electric current from an electricity supply line for supplying a driving electric current to the LED load.

18. The LED drive circuit according to claim 11, further comprising a photodiode that receives light from the LED load, a low-pass filter that extracts a low-frequency component from an output from the photo diode, and an amplitude detection portion that monitors an amplitude of the extracted low-frequency component; wherein based on an amplitude detection signal input from the amplitude detection portion, the adjustment signal generation portion generates the adjustment signal.

19. An LED illumination apparatus comprising:

an LED drive circuit according to claim 11, that is connectable to a phase control type of light adjuster and receives a voltage based on an a.c. voltage to drive an LED load, includes: an adjustment signal generation portion that generates an adjustment signal in accordance with a characteristic of a phase control type of light adjuster which is connected to the LED drive circuit; and an adjustment portion that receives the adjustment signal to adjust a characteristic for driving the LED load; and the LED load connected to an output side of the LED drive circuit.

* * * * *